US011106150B2

(12) United States Patent
Nagayama et al.

(10) Patent No.: US 11,106,150 B2
(45) Date of Patent: Aug. 31, 2021

(54) CARRIER, DEVELOPER, METHOD, AND APPARATUS FOR FORMING ELECTROPHOTOGRAPHIC IMAGE, AND PROCESS CARTRIDGE

(71) Applicant: RICOH COMPANY, LTD., Tokyo (JP)

(72) Inventors: Masashi Nagayama, Shizuoka (JP); Hiroyuki Kishida, Shizuoka (JP); Masahiro Seki, Nara (JP); Yoshimichi Ishikawa, Hyogo (JP); Saori Yamada, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/683,534

(22) Filed: Nov. 14, 2019

(65) Prior Publication Data

US 2020/0166867 A1 May 28, 2020

(30) Foreign Application Priority Data

Nov. 22, 2018 (JP) ..... JP2018-219104

(51) Int. Cl.
*G03G 9/113* (2006.01)
*G03G 9/107* (2006.01)

(52) U.S. Cl.
CPC ..... *G03G 9/1139* (2013.01); *G03G 9/107* (2013.01); *G03G 9/1085* (2020.08); *G03G 9/1131* (2013.01)

(58) Field of Classification Search
CPC ..... G03G 9/1131; G03G 9/1139; G03G 9/107
See application file for complete search history.

(56) References Cited

U.S. PATENT DOCUMENTS

| | | | | |
|---|---|---|---|---|
| 6,242,146 | B1 * | 6/2001 | Ishihara | G03G 9/10 430/110.4 |
| 6,500,595 | B1 | 12/2002 | Mochizuki et al. | |
| 2015/0104739 | A1 * | 4/2015 | Nagatomo | G03G 9/09725 430/105 |
| 2015/0220014 | A1 * | 8/2015 | Kawauchi | G03G 9/1136 430/106.2 |
| 2015/0248074 | A1 | 9/2015 | Suzuki et al. | |
| 2015/0253685 | A1 | 9/2015 | Suzuki et al. | |
| 2016/0033924 | A1 | 2/2016 | Fukao et al. | |
| 2016/0041487 | A1 * | 2/2016 | Kawauchi | G03G 9/1136 430/106.2 |
| 2016/0327884 | A1 | 11/2016 | Nakajima et al. | |
| 2017/0010548 | A1 | 1/2017 | Nozaki et al. | |
| 2017/0153563 | A1 | 6/2017 | Kishida et al. | |
| 2017/0185000 | A1 * | 6/2017 | Nagayama | G03G 15/0121 |
| 2017/0205721 | A1 | 7/2017 | Murasawa et al. | |
| 2017/0248871 | A1 | 8/2017 | Iwatsuki et al. | |
| 2017/0248896 | A1 | 8/2017 | Nakatake et al. | |
| 2017/0269497 | A1 | 9/2017 | Murasawa et al. | |
| 2017/0329247 | A1 | 11/2017 | Murasawa et al. | |
| 2018/0031992 | A1 | 2/2018 | Seki et al. | |
| 2018/0113391 | A1 | 4/2018 | Yamauchi et al. | |
| 2018/0113393 | A1 | 4/2018 | Seki et al. | |
| 2018/0120724 | A1 | 5/2018 | Sakata et al. | |
| 2018/0267421 | A1 | 9/2018 | Takii et al. | |
| 2019/0011847 | A1 | 1/2019 | Ogawa et al. | |
| 2019/0018331 | A1 | 1/2019 | Takii et al. | |

FOREIGN PATENT DOCUMENTS

| | | | |
|---|---|---|---|
| JP | 54-155048 | | 12/1979 |
| JP | 56-075659 | | 6/1981 |
| JP | 57-040267 | | 3/1982 |
| JP | 57-168255 | | 10/1982 |
| JP | 58-108548 | | 6/1983 |
| JP | 58-108549 | | 6/1983 |
| JP | 58-117555 | | 7/1983 |
| JP | 59-166968 | | 9/1984 |
| JP | 2-079862 | | 3/1990 |
| JP | 3-073968 | | 3/1991 |
| JP | 4-360156 | | 12/1992 |
| JP | 5-273789 | | 10/1993 |
| JP | 5-303238 | | 11/1993 |
| JP | 6-202381 | | 7/1994 |
| JP | 8-006307 | | 1/1996 |
| JP | 8-179570 | | 7/1996 |
| JP | 08179570 | A * | 7/1996 |
| JP | 8-286429 | | 11/1996 |
| JP | 08286429 | A * | 11/1996 |
| JP | 11-174740 | | 7/1999 |
| JP | 2001-117287 | | 4/2001 |
| JP | 2002-296846 | | 10/2002 |
| JP | 2017-120394 | | 7/2017 |

OTHER PUBLICATIONS

English language machine translation of JP 08-286429. (Year: 1996).*
Diamond, A.S. (ed). Handbook of Imaging Materials. New York: Marcel-Dekker, Inc. pp. 145-164. (Year: 2001).*
U.S. Appl. No. 16/305,196, filed May 26, 2017, Haruki Murata, et al.

* cited by examiner

*Primary Examiner* — Christopher D Rodee
(74) *Attorney, Agent, or Firm* — Grüneberg and Myers PLLC

(57) ABSTRACT

A carrier for forming an electrophotographic image is provided. The carrier includes a core particle comprising a manganese-based ferrite particle having an apparent density of from 2.0 to 2.2 g/cm$^3$ and a magnetization of from 44 to 52 emu/g in a magnetic field of 500 Oe; and a coating layer coating a surface of the core particle. The coating layer contains a carbon black, an inorganic particle A, and an inorganic particle B. The inorganic particle A and the carbon black each have a concentration gradient in a thickness direction of the coating layer. A concentration of the inorganic particle A increases toward a surface of the coating layer, and a concentration of the carbon black decreases toward the surface of the coating layer.

14 Claims, 1 Drawing Sheet

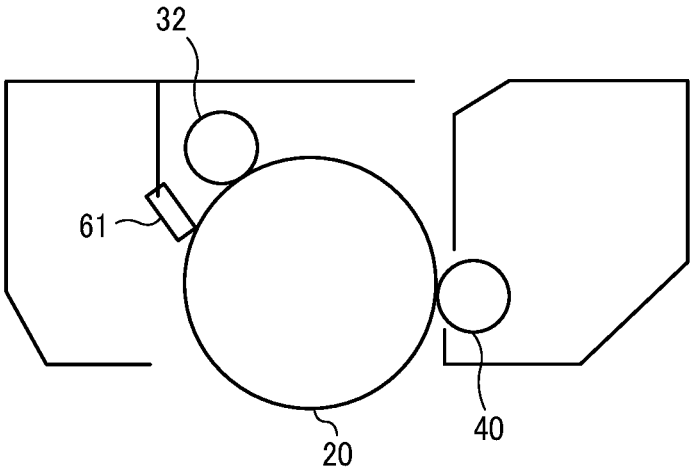
32
61
20
40

CARRIER, DEVELOPER, METHOD, AND APPARATUS FOR FORMING ELECTROPHOTOGRAPHIC IMAGE, AND PROCESS CARTRIDGE

CROSS-REFERENCE TO RELATED APPLICATIONS

This patent application is based on and claims priority pursuant to 35 U.S.C. § 119(a) to Japanese Patent Application No. 2018-219104, filed on Nov. 22, 2018, in the Japan Patent Office, the entire disclosure of which is hereby incorporated by reference herein.

BACKGROUND

Technical Field

The present disclosure relates to a carrier for forming an electrophotographic image, a developer for forming an electrophotographic image, a method for forming an electrophotographic image, an apparatus for forming an electrophotographic image, and a process cartridge.

Description of the Related Art

Generally, image forming methods such as electrophotography and electrostatic photography employ a two-component development system using a two-component developer obtained by mixing a toner and a carrier, or a one-component development system using a one-component developer free of carrier, for developing an electrostatic latent image formed on a latent image bearer. The two-component development system is advantageous over the one-component development system in maintaining high image quality over an extended period of time because the carrier provides a wide area for triboelectrically charging the toner and has stable chargeability. The two-component development system is often used particularly in high-speed machines since the capability of supplying toner to the developing region is high. In addition, due to the above-described advantages, the two-component development system is widely employed in digital electrophotographic systems that visualize an electrostatic latent image formed on a photoconductor with a laser beam.

Various attempts have been made to increase the durability of granular carriers used in such two-component development systems. For example, there has been an attempt to coating a carrier with an appropriate resin material for the purpose of preventing spent toner from adhering to the surface of the carrier, forming a uniform surface on the carrier, preventing oxidation of the surface, preventing a decrease in moisture sensitivity, extending the lifespan of the developer, protecting the photoconductor from scratch or abrasion by the carrier, controlling the charge polarity, or adjusting the charge amount.

For example, carriers coated with a specific resin material, carriers in which various additives are added to the coating layer, and carriers in which additives are attached to the carrier surface have been proposed. As another example, a carrier coated with a carrier coating material composed of a guanamine resin and a thermosetting resin capable of cross-linking with the guanamine resin has been proposed. A carrier coated with a carrier coating material composed of a cross-linked product of a melamine resin and an acrylic resin has also been proposed. A carrier having a resin layer has also been proposed which contains a resin component obtained by cross-linking a thermoplastic resin with a guanamine resin and further contains a charge controlling agent.

A resin-coated carrier in which a conductive carbon is dispersed as a conducting agent in the carrier coating layer has also been proposed.

Carriers in which a conductive filler is contained in the carrier coating layer have also been proposed.

A carrier having an inner layer containing carbon black and an outer coating layer containing only a resin has also been proposed.

A carrier provided with a coating layer containing a white conducting agent and further provided with another layer containing carbon black on the inner side of the coating layer has also been proposed.

A carrier in which carbon black having an excellent resistance adjusting function is contained in a coating layer and the amount of the carbon black is reduced toward the carrier surface has also been proposed.

SUMMARY

In accordance with some embodiments of the present invention, a carrier for forming an electrophotographic image is provided. The carrier includes a core particle comprising a manganese-based ferrite particle having an apparent density of from 2.0 to 2.2 g/cm$^3$ and a magnetization of from 44 to 52 emu/g in a magnetic field of 500 Oe; and a coating layer coating a surface of the core particle. The coating layer contains a carbon black, an inorganic particle A, and an inorganic particle B. The inorganic particle A and the carbon black each have a concentration gradient in a thickness direction of the coating layer. A concentration of the inorganic particle A increases toward a surface of the coating layer, and a concentration of the carbon black decreases toward the surface of the coating layer.

In accordance with some embodiments of the present invention, a developer for forming an electrophotographic image is provided. The developer includes the above-described carrier and a toner.

In accordance with some embodiments of the present invention a method for forming an electrophotographic image is provided. The method includes the processes of charging an electrostatic latent image bearer; forming an electrostatic latent image on the electrostatic latent image bearer; developing the electrostatic latent image formed on the electrostatic latent image bearer into a toner image with the above-described developer; transferring the toner image formed on the electrostatic latent image bearer onto a recording medium; and fixing the toner image on the recording medium.

In accordance with some embodiments of the present invention, a process cartridge is provided. The process cartridge includes an electrostatic latent image bearer; a charger configured to charge the electrostatic latent image bearer; a developing device containing the above-described developer, configured to develop an electrostatic latent image formed on the electrostatic latent image bearer with the developer to form a toner image; and a cleaner configured to clean the electrostatic latent image bearer.

BRIEF DESCRIPTION OF THE DRAWING

A more complete appreciation of the disclosure and many of the attendant advantages thereof will be readily obtained as the same becomes better understood by reference to the following detailed description when considered in connection with the accompanying drawing, which is intended to depict example embodiments of the present invention and should not be interpreted to limit the scope thereof. The accompanying drawing is not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

According to an embodiment of the present invention, a carrier for forming an electrophotographic image is provided that has excellent durability, prevents the occurrence of color contamination, and provides stable image quality even when used for a long period of time.

Embodiments of the present invention are described in detail below.

As described above, embodiments of the present invention provide the following item 1).

1) A carrier for forming an electrophotographic image, comprising: a core particle comprising a manganese-based ferrite particle having an apparent density of from 2.0 to 2.2 g/cm$^3$ and a magnetization of from 44 to 52 emu/g in a magnetic field of 500 Oe; and a coating layer coating a surface of the core particle, the coating layer containing a carbon black, an inorganic particle A, and an inorganic particle B, wherein the inorganic particle A and the carbon black each have a concentration gradient in a thickness direction of the coating layer, a concentration of the inorganic particle A increases toward a surface of the coating layer, and a concentration of the carbon black decreases toward the surface of the coating layer.

According to the carrier for forming an electrophotographic image as the item 1), the developer is highly bulky and highly magnetized in a developing device. As a result, a developing roller is able to easily draw up the developer and the developer is less likely to be depleted on the developing roller, preventing non-uniform image density caused by depletion of the developer. In addition, while the carbon black exerts an excellent resistance adjustment function, the presence of the inorganic particle B makes the coating layer more difficult to be scraped off. Furthermore, even when the coating layer gets scraped little by little over a long-term use, the toner is prevented from being contaminated by the dark black color of the carbon black.

Further, preferred embodiments of the present invention provide the following items 2) to 11).

2) The carrier for forming an electrophotographic image according to 1) above, wherein the core particle has a magnetization of from 60 to 70 emu/g in a magnetic field of 1,000 Oe.

According to the carrier for forming an electrophotographic image as the item 2), the developer drawn up on the developing roller exhibits a strong magnetic binding force to the developing roller. As a result, a phenomenon called carrier deposition is prevented, in which the carrier detached from the developing roller in the developing region gets deposited on a latent image bearer to induce a spot-like abnormal image.

3) The carrier for forming an electrophotographic image according to the item 1) or 2), wherein the core particle comprises strontium.

According to the carrier for forming an electrophotographic image as the item 3), the surface of the core particle is formed with appropriate irregularities, and the apparent density of the core particle is reliably kept equal to or less than 2.2 g/cm$^3$.

4) The carrier for forming an electrophotographic image according to any of the items 1) to 3), wherein a proportion of the carbon black in a region extending from 0.0 to 0.1 μm-depth from the surface of the coating layer is from 0% to 30% by volume, wherein the inorganic particle A comprises a conductive particle having a powder resistivity of 200 Ω·cm or less.

According to the carrier for forming an electrophotographic image as the item 4), the toner is effectively prevented from being contaminated by the dark black color of the carbon black, and the inorganic particle A reliably exerts a conducting function as a conductive particle instead of the carbon black in the vicinity of the surface of the coating layer.

5) The carrier for forming an electrophotographic image according to any of the items 1) to 4), wherein the inorganic particle A comprises a tin oxide doped with at least one member selected from the group consisting of tungsten, indium, phosphorus, and oxides of tungsten, indium, and phosphorus, or wherein the conductive particle A comprises a base particle and the tin oxide doped with the at least one member disposed on a surface of the base particle.

According to the carrier for forming an electrophotographic image as the item 5), even when the coating layer is gradually scraped over a long-term use and the inorganic particle A is detached from the carrier, color contamination of the toner is prevented for low coloring of the inorganic particle A.

6) A developer for forming an electrophotographic image, comprising the carrier for forming an electrophotographic image according to any of the items 1) to 5).

According to the developer for forming an electrophotographic image as the item 6), the developer provides excellent durability, prevents the occurrence of color contamination, and provides stable image quality even when used for a long period of time, since the developer contains the developer for forming an electrophotographic image according to an embodiment of the present invention.

7) The developer for forming an electrophotographic image according to the item 6), further comprising a negatively-chargeable toner, wherein the inorganic particle B comprises at least one member selected from the group consisting of barium sulfate, zinc oxide, magnesium oxide, magnesium hydroxide, and hydrotalcite.

According to the developer for forming an electrophotographic image as the item 7), the developer provides a stable charging ability because the inorganic particle B have a positive chargeability.

8) The developer for forming an electrophotographic image according to the item 6) or 7), further comprising at least one member selected from the group consisting of a color toner, a white toner, and a transparent toner.

According to the developer for forming an electrophotographic image as the item 8), the developer remarkably exhibits its function of preventing toner contamination.

9) A method for forming an electrophotographic image, using the developer for forming an electrophotographic image according to any of the items 6) to 8).

According to the method for forming an electrophotographic image as the item 9), the method provides excellent durability, prevents the occurrence of color contamination, and provides stable image quality even when used for a long period of time, since the developer for forming an electrophotographic image according to an embodiment of the present invention is used.

10) An apparatus for forming an electrophotographic image, using the developer for forming an electrophotographic image according to any of the items 6) to 8).

According to the apparatus for forming an electrophotographic image as the item 10), the apparatus provides excellent durability, prevents the occurrence of color contamination, and provides stable image quality even when used for a long period of time, since the developer for forming an electrophotographic image according to an embodiment of the present invention is used.

11) A process cartridge for forming an electrophotographic image, using the developer for forming an electrophotographic image according to any of the items 6) to 8).

According to the process cartridge as the item 11), the process cartridge is detachably mountable on an image forming apparatus and able to form an image using the carrier and developer according to some embodiments of the present invention.

In the item 1), carbon black having an excellent resistance adjustment function is contained in the coating layer such that the concentration of the carbon black gradually decreases toward the surface of the coating layer. Therefore, even when the coating component is detached from the carrier as the coating layer is scraped off, the amount of the carbon black contained in the detached coating component is small. As a result, the occurrence of color contamination on the toner can be prevented. In this case, however, there is a concern that the electrical resistance of the coating layer near the surface increases due to the decreasing of the concentration of the carbon black toward the surface. To eliminate such a concern, the amount of the inorganic particle A having conductivity is made to increase toward the surface of the coating layer where the amount of the carbon black is small. As a result, the electrical resistance of the surface side becomes equivalent to that of the deep side where the concentration of the carbon black is high.

In view of related art, when the coating layer contains the inorganic particle A as a conductive material in place of carbon black and the inorganic particle B as a filler for ensuring the strength of the coating layer, the coating layer is resulted to contain a relatively large amount of inorganic particles. As a result, the magnetization of the coating layer is lowered, and the risk for the occurrence of non-uniform image density due to insufficient drawing-up (depletion) of the developer on the developing roller is increased. The inventors of the present invention have reached a technical concept that drawing up of the developer on the developing roller is ensured by increasing the magnetization of the core particle and decreasing the apparent density of the core particle even when the carrier has the above-described layer configuration. In particular, the inventors have come to the conclusion that depletion of the developer on the developing roller can be remarkably prevented when the magnetization ($\sigma 500$) of the core particle in a magnetic field of 500 Oe is 44 emu/g or more and the apparent density thereof is 2.2 g/cm$^3$ or less.

However, if $\sigma 500$ of the core particle is too high, a phenomenon called ghost occurs in which the developer whose toner concentration has been lowered after image development enters the developing region again without separating from the developing roller to lower the image density of the solid image after the second round of the developing roller. The inventors of the present invention have found that, when $\sigma 500$ of the core particle is 52 emu/g or less, the risk for causing ghost due to the above-described mechanism can be remarkably prevented.

On the other hand, if the apparent density of the core particle is too low, the magnetic binding force exerted from the developing roller acting on each particle becomes weak. Therefore, not only the developer cannot be effectively drawn up onto the developing roller, but also the risk for causing a phenomenon called carrier deposition becomes very high, in which carrier particles move to a latent image bearer due to the Coulomb force in the developing region. In addition, even when the volume of the developer in the developing device is unchanged, as the apparent density of the core particle lowers, the number of carrier particles in the developer lowers. As a result, a small amount of carrier particles is exposed to hazards caused by a long-term image output, resulting in a short lifetime of the carrier. The inventors of the present invention have searched the limit of the apparent density that can withstand these risks and have come to the conclusion that these risks are significantly reduced when the apparent density of the core particle is 2.0 g/cm$^3$ or more.

The magnetization of the core particle is measured with a High Sensitivity Vibrating Sample Magnetometer (VSM-P7 manufactured by Toei Industry Co., Ltd.) of use for room temperature. In the measurement, an external magnetic field is continuously applied in the range of from 0 to 1,000 Oe for one cycle to measure a magnetization $\sigma 1000$ in an external magnetic field of 1,000 Oe and a magnetization $\sigma 500$ in an external magnetic field of 500 Oe.

The apparent density of the core particle is measured according to JIS (Japanese Industrial Standards) Z2504: 2000.

Preferably, $\sigma 1000$ of the core particle is from 60 to 70 emu/g. According to this preferred embodiment, the developer drawn up on the developing roller exhibits a strong magnetic binding force to the developing roller. As a result, a phenomenon called carrier deposition is prevented, in which the carrier detached from the developing roller in the developing region gets deposited on a latent image bearer to induce a spot-like abnormal image.

The volume average particle diameter of the core particle is not particularly limited. For preventing the occurrence of carrier deposition and carrier scattering, the volume average particle diameter is preferably 20 μm or more. For preventing the production of abnormal images (e.g., stripes made of carrier particles) and deterioration of image quality, the volume average particle diameter is preferably 100 μm or less. In particular, core particles having a volume average particle diameter of from 20 to 60 μm can meet a recent demand for higher image quality. The volume average particle diameter can be measured by, for example, a particle size distribution analyzer MICROTRAC Model HRA9320-X100 (manufactured by Nikkiso Co., Ltd.).

The core particle may be appropriately selected to suit to a particular application from among those known as carriers used for electrophotographic two-component developers, as long as it is a magnetic material whose apparent density and magnetization are within the above-defined ranges. Specific examples thereof include, but are not limited to, ferromagnetic metals such as iron and cobalt, iron oxides such as magnetite, hematite, and ferrite, various alloys and compounds, and resin particles in which these magnetic materials are dispersed. Among these materials, Mn-based ferrites such as Mn—Mg ferrite and Mn—Mg—Sr ferrite are preferable from the environmental point of view. For forming irregularities on the surface of the core particle and stably keeping the apparent density low, Sr-containing Mn-based ferrites are more preferable, and Mn—Mg—Sr ferrite is particularly preferable. Specific preferred examples thereof include, but are not limited to, LDC-200 (available from Powdertech Co., Ltd.) and DFC-09S-128 (available from DOWA Electronics Materials Co., Ltd.).

Preferably, the core particle has a shape factor SF2 of from 120 to 160 and an arithmetic mean roughness Ra of from 0.5 to 1.0 μm. The core particle having such a shape provides a carrier having excellent charge stability and resistance stability over time. Although detailed reasons are unclear, it is considered that, when the shape factor and arithmetic mean roughness of the core particle are within the above-described ranges, the surface of the carrier is formed with irregularities with an appropriate size, which exerts the effect of scraping off the toner spent on the carrier, thereby preventing a decrease in charge and an increase in resistance caused due to the spent toner. When the shape factor SF2 of the core particle is 120 or more, the carrier is formed with appropriate irregularities without becoming a true-sphere-like shape, thereby exerting the effect of scraping off the spent toner. When the shape factor SF2 of the core particles is 160 or less, the core particle is prevented from being exposed when used in the developing device for a long time. Thus, a change in resistance value from the initial stage to after use is small, and the amount of toner on the latent image bearer and how the toner come onto the latent image bearer change little, thus stabilizing the image quality.

The shape factors SF1 and SF2 are described in detail below.

The shape factors SF1 and SF2 are defined by the following formulae (1) and (2) and can be determined by, for example, imaging 100 randomly-selected core particles with a field emission scanning electron microscope (FE-SEM S-800 available from Hitachi, Ltd.) at a magnification of 300 times and introducing the image information to an image analyzer (LUZEX AP available from Nireco Corporation) via an interface to analyze the image information.

$$SF1=(L^2/A)\times(\pi/4)\times 100 \quad (1)$$

$$SF2=(P^2/A)\times(1/4\pi)\times 100 \quad (2)$$

In the formulae (1) and (2), L represents the absolute maximum length of a projected image of a core particle (i.e., the diameter of the circumscribed circle of the projected image), P represents the perimeter of the projected image of the core particle, and A represents the area of the projected image of the core particle.

The shape factor SF1 represents the degree of roundness of a particle. The shape factor SF2 represents the degree of irregularity of a particle. As the shape becomes more apart from the circle (sphere), the SF1 value becomes larger. As the surface irregularity becomes larger, the SF2 value becomes larger.

From the viewpoint of prevention of color contamination, the amount of carbon black at the outermost surface of the coating layer is ideally zero. However, in order to eliminate carbon black from the outermost surface, the coating layer should be formed to have a thick layer portion containing no carbon black since carbon black also has a particle size, which may naturally increase the used amount of the inorganic particle A having conductivity. In order to prevent color contamination, the inorganic particle A is preferably selected from materials with a color as light as possible. However, since conductive materials with a light color are often made from rare earth, from the viewpoint of resource protection, it is preferable that the used amount of the inorganic particle A be reduced without eliminating carbon black from the surface of the coating layer as long as the degree of color contamination is acceptable.

Based on this technical concept, the inventors of the present invention examined an appropriate amount of carbon black. As a result, the inventors have come to the conclusion that, even when the proportion of the carbon black in a region extending from 0.0 to 0.1 μm-depth from the surface of the coating layer is about 30% by volume, the degree of color contamination of the toner is within an allowable range since scraping off of the coating layer is prevented by the presence of the inorganic particle B.

In the coating layer, the inorganic particle A and the carbon black each have a concentration gradient in a thickness direction. The concentration of the inorganic particle A increases toward the surface of the coating layer, and the concentration of the carbon black decreases toward the surface of the coating layer.

In the present disclosure, how to provide the concentration gradient in the coating layer is not particularly limited. One example method involves coating the core particle with a resin solution containing the carbon black and the inorganic particle A (and optionally the inorganic particle B) multiple times with the concentrations of the carbon black and the inorganic particle A in the resin solution making lower and higher, respectively, in the later processes. Another example method involves, using multiple spray coating nozzles including one for spraying a resin solution containing the carbon black and another one for spraying a resin solution containing the inorganic particle A (and optionally the inorganic particle B), continuously increasing the spraying rate of the resin solution containing the inorganic particle A (and optionally the inorganic particle B) while continuously decreasing the spraying rate of the resin solution containing carbon black.

The concentration gradients of the inorganic particle A and the carbon black in the coating layer may be formed either in a continuous manner or in a stepwise manner in the direction toward the surface of the coating layer from the core particle of the carrier.

Preferably, the proportion of the carbon black in a region extending from 0.0 to 0.1 μm-depth from the surface of the coating layer is from 3% to 29% by volume.

The location of the carbon black and the inorganic particle A in the coating layer and the volume ratio thereof in the vicinity of the surface can be confirmed by conventionally known methods. One example method involves cutting the coating layer on the surface of the carrier with a focused ion beam (FIB) and observing the cross-section by scanning electron microscopy (SEM) and/or energy-dispersive X-ray spectrometry (EDX). Another non-limiting example method is described below.

First, a sample is adhered onto a piece of carbon tape and get an osmium coating having a thickness of about 20 nm for protecting the surface and giving conductivity. The sample is then subjected to an FIB treatment using an instrument NVision 40 (product of Carl Zeiss (SII)) under the following conditions.

Accelerating Voltage: 2.0 kV
Aperture: 30 μm
High Current: ON
Detector: SE2
In Lens
Conductive Treatment: None
W.D.: 5.0 mm
Sample Tilt Angle: 54°

The sample is then subjected to a SEM observation and an element mapping using an electron cooling SDD detector ULTRA DRY (having a diameter of 30 $mm^2$) and an analysis software program NORAN System 6 (NSS), both products of Thermo Fischer Scientific Inc., under the following conditions, to confirm the locations of the carbon black and the inorganic particle A and the occupied areas thereof in the cross-section of the coating layer in the vicinity of the surface.

Accelerating Voltage: 3.0 kV
Aperture: 120 μm
High Current: ON
Conductive Treatment: Os
Drift Correction: Yes
W.D.: 10.0 mm
Measurement Method: Area Scan
Accumulation Time: 10 sec
Accumulation Number: 100 times
Sample Tilt Angle: 54°

The proportion in volume of the carbon black in the vicinity of the surface of the coating layer is determined from the ratio of the ⅗th power of the cross-sectional area of the carbon black to the ⅗th power of the cross-sectional area of the region extending from 0.0 to 0.1 μm-depth from the surface.

As described above, the inorganic particle A plays a role of ensuring the resistance adjustment function instead of the carbon black that has been reduced in amount according to the concentration gradient. Therefore, it is preferable that the inorganic particle A have a high electrical conductivity. The inventors of the present invention examined the powder resistivity required for the inorganic particle A. As a result, it was concluded that the powder resistivity of the inorganic particle A is preferably 200 Ω·cm or less, more preferably 100 Ω·cm or less. When the powder resistivity of the inorganic particle A is 200 Ω·cm or less, it is not necessary to prescribe the inorganic particle A in large amounts for performing the resistance adjustment function, and spillage from the surface of the coating layer can be prevented. If the inorganic particle A having the resistance adjustment function spill from the surface of the coating layer, the carrier resistance will increase, and the carrier resistance will change at an early stage over time, resulting in poor stability in image quality. The powder resistivity of the inorganic particle A is preferably from 30 to 190 Ω·cm.

The powder resistivity may be measured by the following method.

A steel electrode is placed on the bottom of a vinyl chloride tube having an inner diameter of 1 inch, then 5 g of a sample is put in the vinyl chloride tube, and a steel electrode is placed on the top of the vinyl chloride tube. A polytetrafluoroethylene plate having a thickness of 2 mm is placed on each of the electrodes at the top and bottom, and a load of kg/$cm^2$ is applied by a hydraulic press. An LCR meter (4261A manufactured by Yokogawa Hewlett-Packard Japan, Ltd.) is brought into connection with the electrodes being pressurized. A resistance value r [Ω] is read immediately after the connection and the total length L [cm] is measured with a caliper. The powder resistivity R is calculated by the following equation, where 1 represents the total length when the tube is filled with no sample.

$$R[\Omega\cdot\text{cm}]=(2.54/2)^2\pi r/(L-l)$$

The type of the inorganic particle A can be appropriately selected. Although the presence of the inorganic particle B reduces the degree of scraping of the surface of the coating layer containing the inorganic particle A, the coating layer containing the inorganic particle A gets scraped little by little through a long-term use. At that time, to minimize color contamination of the toner caused by the inorganic particle A detached from the coating layer or the inorganic particle A contained in the detached coating layer, it is preferable that the inorganic particle A be close to white or colorless as much as possible. Examples of materials having good color and conductive function include, but are not limited to, compounds in which tin oxide is doped with tungsten, indium, phosphorus, or an oxide of any of these substances. In addition, fine particles having these compounds on the surfaces of base particles are also usable. The material of the base particles can be appropriately selected. Examples thereof include, but are not limited to, aluminum oxide and titanium oxide.

The coating layer contains the inorganic particle B.

As the coating layer contains the inorganic particle B, the coating layer is improved in durability against scraping. The material of the inorganic particle B is not particularly limited. For example, when used in combination with a negatively-chargeable toner, the inorganic particle B is preferably made of a positively-chargeable material for reliably providing a charge imparting ability for an extended period of time. Particularly preferred materials include barium sulfate, zinc oxide, magnesium oxide, magnesium hydroxide, and hydrotalcite.

Preferably, the particle diameter h of the inorganic particle B and the average thickness T of the coating layer have the following relation.

$$h/2\leq T\leq h$$

When the particle diameter of the inorganic particle B is equal to or greater than the thickness of the coating layer, the probability that the inorganic particle B protrudes from the surface of the coating layer is increased. The top portion of the inorganic particle B protruding from the coating layer functions as a spacer between an object to be rubbed and the resin of the coating layer, when the carrier particles are rubbed with each other or with a container wall or a conveyance jig, thus extending the life of the coating layer. Further, when the inorganic particle B is given a positive charge imparting function and used in combination with a negatively-chargeable toner as a developer as described above, the probability that the inorganic particle B contacts the toner is increased, which is preferable in terms of charge imparting function. Further, when the thickness T of the coating layer is larger than the half of the particle diameter of the inorganic particle B, the inorganic particle B is firmly captured by the resin in the coating layer, so that the inorganic particle B is unlikely to detach from the coating layer.

The particle diameter of the inorganic particle B is from 0.30 to 1.00 μm, preferably from 0.50 to 0.65 μm.

The average particle diameter of the inorganic particle can be measured by, for example, NANOTRAC UPA series (manufactured by Nikkiso Co., Ltd.) before the inorganic particle is put in the coating layer. In the case in which the inorganic particle has already been put in the coating layer, the average particle diameter can be measured in the same manner as in confirming the locations of the carbon black and the inorganic particle A or from an image observed by SEM with a simpler apparatus. Similarly, the thickness of the coating layer can be measured from an image observed by SEM. Since each inorganic particle A has an individual difference and the thickness of the coating layer varies depending on the location, not only one particle or one location is subjected to the measurement, but a statistically reliable number of particles or location is subjected to the measurement.

The resin used for the coating layer may include a silicone resin, an acrylic resin, or a combination thereof. Acrylic resins have high adhesiveness and low brittleness and thereby exhibit superior wear resistance. At the same time, acrylic resins have a high surface energy. Therefore, when an acrylic resin is used in combination with a toner which easily gets spent, the spent toner components may be accumulated on the acrylic resin to cause a decrease of the amount of charge. This problem can be solved by using a silicone resin in combination with the acrylic resin. This is because silicone resins have a low surface energy and the spent toner components are less likely to adhere thereto, which prevents accumulation of the spent toner components that causes detachment of the coating film. At the same time, silicone resins have low adhesiveness and high brittleness and therefore the wear resistance thereof is poor. It is preferable that the coating layer contain the acrylic resin and the silicone resin in a good balance, so that the spent toner is less likely to adhere thereto and the wear resistance thereof is improved. This is because silicone resins have a low surface energy and the spent toner components are less likely to adhere thereto, which prevents accumulation of the spent toner components that causes detachment of the coating film.

In the present disclosure, silicone resins refer to all known silicone resins. Examples thereof include, but are not limited to, straight silicone resins consisting of organosiloxane bonds, and modified silicone resins (e.g., alkyd-modified, polyester-modified, epoxy-modified, acrylic-modified, and urethane-modified silicone resins). Specific examples of the straight silicone resins include, but are not limited to, commercially-available products such as KR271, KR255, and KR152 (available from Shin-Etsu Chemical Co., Ltd.); and SR2400, SR2406, and SR2410 (available from Dow Corning Toray Co., Ltd.). Each of these silicone resins may be used alone or in combination with a cross-linkable component and/or a charge amount controlling agent. Specific examples of the modified silicone resins include, but are not limited to, commercially-available products such as KR206 (alkyd-modified), KR5208 (acrylic-modified), ES1001N (epoxy-modified), and KR305 (urethane-modified) (available from Shin-Etsu Chemical Co., Ltd.); and SR2115 (epoxy-modified) and SR2110 (alkyd-modified) (available from Dow Corning Toray Co., Ltd.).

Examples of polycondensation catalysts include titanium-based catalysts, tin-based catalysts, zirconium-based catalysts, and aluminum-based catalysts. Among these catalysts, titanium-based catalysts are preferable for their excellent effects, and titanium diisopropoxybis(ethylacetoacetate) is most preferable. The reason for this is considered that this catalyst effectively accelerates condensation of silanol groups and is hardly to be deactivated.

In the present disclosure, acrylic resins refer to all known resins containing an acrylic component and are not particularly limited. Each of these acrylic resins may be used alone or in combination with at least one cross-linking component. Specific examples of the cross-linking component include, but are not limited to, amino resins and acidic catalysts. Specific examples of the amino resins include, but are not limited to, guanamine resin and melamine resin. The acidic catalysts here refer to all materials having a catalytic action. Specific examples thereof include, but are not limited to, those having a reactive group of a completely alkylated type, a methylol group type, an imino group type, or a methylol/imino group type.

More preferably, the coating layer contains a cross-linked product of an acrylic resin and an amino resin. In this case, the coating layers are prevented from fusing with each other while remaining the proper elasticity.

Examples of the amino resin include, but are not limited to, melamine resins and benzoguanamine resins, which can improve charge giving ability of the resulting carrier. To more properly control charge giving ability of the resulting carrier, a melamine resin and/or a benzoguanamine resin may be used in combination with another amino resin.

Preferred examples of the acrylic resin that is cross-linkable with the amino resin include those having a hydroxyl group and/or a carboxyl group. Those having a hydroxy group are more preferred. In this case, adhesiveness to the core particle and inorganic particles is more improved, and dispersion stability of the inorganic particles is also improved. In this case, preferably, the acrylic resin has a hydroxyl value of 10 mgKOH/g or more, more preferably 20 mgKOH/g or more.

The proportion of the resin in the coating layer may be from 20% to 60% by mass, and preferably from 30% to 50% by mass.

Preferably, the coating layer contains a silane coupling agent. In this case, the inorganic particles A and B can be reliably dispersed.

Specific examples of the silane coupling agent include, but are not limited to, γ-(2-aminoethyl)aminopropyltrimethoxysilane, γ-(2-aminoethyl)aminopropylmethyl dimethoxysilane, γ-methacryloxypropyltrimethoxysilane, N-β-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl [3-(trimethoxysilyl)propyl] ammonium chloride, γ-chloropropylmethyldimethoxysilane, methyltrichlorosilane, dimethyldichlorosilane, trimethylchlorosilane, allyltriethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl(3-trimethoxysilylpropyl) ammonium chloride. Two or more of these may be used in combination.

Specific examples of commercially-available silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (available from Dow Corning Toray Co., Ltd.).

Preferably, the proportion of the silane coupling agent to the silicone resin is from 0.1% to 10% by mass. When the proportion of the silane coupling agent is 0.1% by mass or more, the adhesion strength between the core particles/inorganic particles and the silicone resin is improved, and the core particles/inorganic particles are prevented from detaching from the coating layer during a long-term use. When the proportion is 10% by mass or less, the occurrence of toner filming is prevented during a long-term use.

The average thickness T of the coating layer may be from 0.15 to 1.00 μm, preferably from 0.25 to 0.65 μm.

A developer according to an embodiment of the present invention contains the carrier according to an embodiment of the present invention and a toner.

The toner contains a binder resin. The toner may be any of black toner, color toner, white toner, or transparent toner. The carrier according to an embodiment of the present invention exhibits the effect of preventing the toner from being contaminated with carbon black. This effect is remarkable when the carrier is used as a developer in combination with a color toner, particularly yellow toner, a white toner, or a transparent toner.

The toner may further contain a release agent so that the toner can be used in oilless fixing systems in which the fixing roller is free of application of toner adherence preventing oil. Although such a toner is likely to cause filming, the carrier according to an embodiment of the present invention can prevent the occurrence of filming, and the developer according to an embodiment of the present invention can provide high-quality images for an extended period of time.

The toner can be produced by known methods such as pulverization methods and polymerization methods. In a typical pulverization method, toner materials are melt-kneaded, the melt-kneaded product is cooled and pulverized into particles, and the particles are classified by size, thus preparing mother particles. To more improve transferability and durability, an external additive is added to the mother particles, thus obtaining a toner.

Specific examples of the kneader for kneading the toner materials include, but are not limited to, a batch-type double roll mill; Banbury mixer; double-axis continuous extruders such as TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KEX EXTRUDER (from Kurimoto, Ltd.); and single-axis continuous extruders such as KOKNEADER (from Buss Corporation).

The cooled melt-kneaded product may be coarsely pulverized by a HAMMER MILL or a ROTOPLEX and thereafter finely pulverized by a jet-type pulverizer or a mechanical pulverizer. Preferably, the pulverization is performed such that the resulting particles have an average particle diameter of from 3 to 15 μm.

When classifying the pulverized melt-kneaded product, a wind-power classifier may be used. Preferably, the classification is performed such that the resulting mother particles have an average particle diameter of from 5 to 20 μm.

The external additive is added to the mother particles by being mixed therewith by a mixer, so that the external additive gets adhered to the surfaces of the mother particles while being pulverized.

Specific examples of the binder resin include, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid, rosin, modified rosin, terpene resin, phenol resin, aliphatic or aromatic hydrocarbon resin, and aromatic petroleum resin. Two or more of these resins can be used in combination.

Specific examples of usable binder resins for pressure fixing include, but are not limited to: polyolefins (e.g., low-molecular-weight polyethylene, low-molecular-weight polypropylene), olefin copolymers (e.g., ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer, ionomer resin), epoxy resin, polyester resin, styrene-butadiene copolymer, polyvinyl pyrrolidone, methyl vinyl ether-maleic acid anhydride copolymer, maleic-acid-modified phenol resin, and phenol-modified terpene resin. Two or more of these resins can be used in combination.

Specific examples of usable colorants (i.e., pigments and dyes) include, but are not limited to, yellow pigments such as Cadmium Yellow, Mineral Fast Yellow, Nickel Titanium Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange pigments such as Molybdenum Orange, Permanent Orange GTR, Pyrazolone Orange, Vulcan Orange, Indanthrene Brilliant Orange RK, Benzidine Orange G, and Indanthrene Brilliant Orange GK; red pigments such as Red Iron Oxide, Cadmium Red, Permanent Red 4R, Lithol Red, Pyrazolone Red, Watching Red calcium salt, Lake Red D, Brilliant Carmine 6B, Eosin Lake, Rhodamine Lake B, Alizarin Lake, and Brilliant Carmine 3B; violet pigments such as Fast Violet B and Methyl Violet Lake; blue pigments such as Cobalt Blue, Alkali Blue, Victoria Blue lake, Phthalocyanine Blue, Metal-free Phthalocyanine Blue, partial chlorination product of Phthalocyanine Blue, Fast Sky Blue, and Indanthrene Blue BC; green pigments such as Chrome Green, chromium oxide, Pigment Green B, and Malachite Green Lake; black pigments such as azine dyes (e.g., carbon black, oil furnace black, channel black, lamp black, acetylene black, aniline black), metal salt azo dyes, metal oxides, and combined metal oxides; and white pigments such as titanium oxide. Two or more of these colorants can be used in combination. The transparent toner may contain no colorant.

Specific examples of the release agent include, but are not limited to, polyolefins (e.g., polyethylene, polypropylene), fatty acid metal salts, fatty acid esters, paraffin waxes, amide waxes, polyvalent alcohol waxes, silicone varnishes, carnauba waxes, and ester waxes. Two or more of these materials can be used in combination.

The toner may further contain a charge controlling agent. Specific examples of the charge controlling agent include, but are not limited to: nigrosine; azine dyes having an alkyl group having 2 to 16 carbon atoms (described in Examined Japanese Application Publication No. 42-1627); basic dyes such as C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. l. Basic Violet 3 (C. l. 42555), C. l. Basic Violet 10 (C. l. 45170), C. l. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), and C. I. Basic Green 4 (C. I. 42000); lake pigments of these basic dyes; quaternary ammonium salts such as C. I. Solvent Black 8 (C. I. 26150), benzoylmethylhexadecyl ammonium chloride, and decyltrimethyl chloride; dialkyl (e.g., dibutyl, dioctyl) tin compounds; dialkyl tin borate compounds; guanidine derivatives; polyamine resins such as vinyl polymers having amino group and condensed polymers having amino group; metal complex salts of monoazo dyes described in Examined Japanese Application Publication Nos. 41-20153, 43-27596, 44-6397, and 45-26478; salicylic acids described in Examined Japanese Application Publication Nos. 55-42752 and 59-7385; metal complexes of dialkyl salicylic acid, naphthoic acid, and dicarboxylic acid with Zn, Al, Co, Cr, and Fe; sulfonated copper phthalocyanine pigments; organic boron salts; fluorine-containing quaternary ammonium salts; and calixarene compounds. Two or more of these materials can be used in combination. For color toners other than black toner, metal salts of salicylic acid derivatives, which are white, are preferable.

Specific examples of the external additive include, but are not limited to, inorganic particles such as silica, titanium oxide, alumina, silicon carbide, silicon nitride, and boron nitride, and resin particles such as polymethyl methacrylate particles and polystyrene particles having an average particle diameter of from 0.05 to 1 μm, obtainable by soap-free emulsion polymerization. Two or more of these materials can be used in combination. Among these, metal oxide particles (e.g., silica, titanium oxide) whose surfaces are hydrophobized are preferable. When a hydrophobized silica and a hydrophobized titanium oxide are used in combination with the amount of the hydrophobized titanium oxide greater than that of the hydrophobized silica, the toner provides excellent charge stability regardless of humidity.

A method for forming an electrophotographic image according to an embodiment of the present invention uses the above-described developer for forming an electrophotographic image according to an embodiment of the present invention. The method may include: a charging process for charging an electrostatic latent image bearer; an irradiating process for forming an electrostatic latent image on the electrostatic latent image bearer; a developing process for developing the electrostatic latent image formed on the electrostatic latent image bearer into a toner image with the developer; a transferring process for transferring the toner image formed on the electrostatic latent image bearer onto a recording medium; and a fixing process for fixing the toner image on the recording medium. The method may further include other known processes such as a neutralizing process, a cleaning process, a recycling process, and a controlling process.

An apparatus for forming an electrophotographic image according to an embodiment of the present invention uses the above-described developer for forming an electrophotographic image according to an embodiment of the present invention. The apparatus may include: an electrostatic latent image bearer; a charger configured to charge the electrostatic latent image bearer; an irradiator configured to form an electrostatic latent image on the electrostatic latent image bearer; a developing device containing the developer, configured to develop the electrostatic latent image formed on the electrostatic latent image bearer with the developer to form a toner image; a transferring device configured to transfer the toner image formed on the electrostatic latent image bearer onto a recording medium; and a fixing device configured to fix the toner image on the recording medium. The apparatus may further include other known devices such as a neutralizer, a cleaner, a recycler, and a controller.

The above-described developer containing the carrier and the toner can be used as either a developer for replenishment or a developer stored in a trickle developing device. In either case, the surface of the carrier is prevented from being abraded, and the spent toner is prevented from adhering to the surface of the carrier. Thus, either the amount of charge of the developer in the developing device or the electrical resistance value of the carrier is prevented from lowering, providing reliable developability.

The configuration of the apparatus for forming an electrophotographic image is not particularly limited, and another image forming apparatus having another configuration may be used as long as it has a similar function.

The process cartridge according to an embodiment of the present invention is illustrated in the drawings. This process cartridge includes a photoconductor 20 (as an electrostatic latent image bearer), a charger 32 in a proximity-type brush shape, a developing device 40 containing the developer according to an embodiment of the present invention, and a cleaner 61 configured to clean the photoconductor 20, and is detachably mountable on an image forming apparatus body. These constituent elements are integrally combined to constitute the process cartridge. The process cartridge is configured to be detachably mountable on an image forming apparatus body such as a copier and a printer.

EXAMPLES

Further understanding can be obtained by reference to certain specific examples which are provided herein for the purpose of illustration only and are not intended to be limiting. In the following descriptions, "parts" represents "parts by mass" and "%" represents "% by mass" unless otherwise specified.

Preparation of Toner

Binder Resin Synthesis Example 1

In a reaction vessel equipped with a condenser tube, a stirrer, and a nitrogen introducing tube, 724 parts of ethylene oxide 2 mol adduct of bisphenol A, 276 parts of isophthalic acid, and 2 parts of dibutyltin oxide were allowed to react at 230 degrees C. for 8 hours under normal pressures and subsequently 5 hours under reduced pressures of from 10 to mmHg. After reducing the temperature to 160 degrees C., 32 parts of isophthalic anhydride were put in the vessel and allowed to react for 2 hours.

After being cooled to 80 degrees C., the vessel contents were further allowed to react with 188 parts of isophorone diisocyanate in ethyl acetate for 2 hours. Thus, an isocyanate-containing prepolymer (P1) was prepared.

Next, 267 parts of the prepolymer (P1) were allowed to react with 14 parts of isophoronediamine at 50 degrees C. for 2 hours. Thus, an urea-modified polyester (U1) having a weight average molecular weight of 64,000 was prepared.

In the same manner as described above, 724 parts of ethylene oxide 2 mol adduct of bisphenol A and 276 parts of terephthalic acid were allowed to polycondensate at 230 degrees C. for 8 hours under normal pressures and subsequently react for 5 hours under reduced pressures of from 10 to 15 mmHg. Thus, an unmodified polyester (E1) having a peak molecular weight of 5,000 was prepared.

Next, 200 parts of the urea-modified polyester (U1) and 800 parts of the unmodified polyester (E1) were dissolved in 2,000 parts of a mixed solvent of ethyl acetate/MEK (methyl ethyl ketone) (mixing ratio was 1/1). Thus, an ethyl acetate/MEK solution of a binder resin (B1) was prepared.

A part of the solution was dried under reduced pressures to isolate the binder resin (B1).

Polyester Resin Synthesis Example A

Terephthalic acid: 60 parts
Dodecenyl succinic anhydride: 25 parts
Trimellitic anhydride: 15 parts
Bisphenol A (2,2) propylene oxide: 70 parts
Bisphenol A (2,2) ethylene oxide: 50 parts The above materials were put in a 1-liter four-necked round-bottom flask equipped with a thermometer, a stirrer, a condenser, and a nitrogen gas introducing tube. The flask was set in a mantle heater and charged with nitrogen gas through the nitrogen gas introducing tube. The flask was heated with an inert gas atmosphere maintained inside the flask. While the flask was kept at 200 degrees C., 0.05 g of dibutyltin oxide were added to the flask and allowed to react. Thus, a polyester A was obtained.

Polyester Resin Synthesis Example B

In a reaction vessel equipped with a thermometer, a stirrer, a condenser tube, and a nitrogen introducing tube, 443 parts of PO adduct of bisphenol A (having a hydroxyl value of 320), 135 parts of diethylene glycol, 422 parts of terephthalic acid, and 2.5 parts of dibutyltin oxide were allowed to react at 200 degrees C. until the acid value reached 10. Thus, a polyester resin B was prepared.

Polyester Resin Synthesis Example C

In a reaction vessel equipped with a thermometer, a stirrer, a condenser tube, and a nitrogen introducing tube, 443 parts of PO adduct of bisphenol A (having a hydroxyl value of 320), 135 parts of diethylene glycol, 422 parts of terephthalic acid, and 2.5 parts of dibutyltin oxide were allowed to react at 230 degrees C. until the acid value reached 7. Thus, a polyester resin C was prepared.

Master Batch Preparation Example 1

Pigment: C.I. Pigment Yellow 155: 40 parts
Binder resin: Polyester resin A: 60 parts
Water: 30 parts The above materials were mixed using a HENSCHEL MIXER to prepare a pigment aggregation into which water had permeated. The pigment aggregation was kneaded by a double roll with its surface temperature set at 130 degrees C. for 45 minutes and then pulverized by a pulverizer into particles having a diameter of about 1 mm. Thus, a master batch (M1) was prepared.

Toner Production Example A

In a beaker, 240 parts of the ethyl acetate/MEK solution of the binder resin (B1), 20 parts of pentaerythritol tetrabehenate (having a melting point of 81 degrees C. and a melt viscosity of 25 cps), and 8 parts of the master batch (M1) were stirred with a TK HOMOMIXER at 12,000 rpm and 60 degrees C. for uniform dissolution and dispersion. Thus, a toner material liquid was prepared.

In another beaker, 706 parts of ion-exchange water, 294 parts of a 10% hydroxyapatite suspension liquid (SUPA-TAITO 10 manufactured by Nippon Chemical Industrial Co., Ltd.), and 0.2 parts of sodium dodecylbenzenesulfonate were uniformly dissolved and heated to 60 degrees C. The above-prepared toner material liquid was put in this beaker while being stirred with a TK HOMOMIXER at 12,000 rpm, and the stirring was continued for 10 minutes.

The resulting mixture was transferred to a flask equipped with a stirrer and a thermometer and heated to 98 degrees C. to remove the solvent, then subjected to filtration, washing, drying, and wind-power classification. Thus, a mother toner particle A was prepared.

Toner Production Example B

Polyester resin B: 40 parts
Polyester resin C: 60 parts
Carnauba wax: 1 part
Carbon black (#44 manufactured by Mitsubishi Chemical Corporation): 10 parts The above toner materials were mixed by a HENSCHEL MIXER 20B (manufactured by Mitsui Mining Co., Ltd.) at 1,500 rpm for 3 minutes and then kneaded with a single-axis kneader (compact BUSS CO-KNEADER manufactured by Buss AG) under the following conditions.

Set temperature at the inlet: 100 degrees C.
Set temperature at the outlet: 50 degrees C.
Feed amount: 2 kg/Hr The kneaded product was rolled and cooled, then pulverized by a pulverizer, and further finely pulverized by an 1-type mill (1DS-2 manufactured by Nippon Pneumatic Mfg. Co., Ltd.) using a flat impact plate under the air pressure of 6.8 atm/cm$^2$ and the feed amount of 0.5 kg/hr, followed by classification (by 132MP manufactured by Alpine). Thus, a mother toner particle B was prepared.

Toner Production Example C

A mother toner particle C was prepared in the same manner as in Toner Production Example B except for replacing the carbon black with 50 parts of titanium oxide.

Toner Production Example D

A mother toner particle D was prepared in the same manner as in Toner Production Example B except for eliminating the carbon black.

Next, 100 parts of each of the mother toner particles A to D were mixed with 1.0 part of a hydrophobic silica and 1.0 part of a hydrophobic titanium oxide using a HENSCHEL MIXER. Thus, toners A to D were prepared.

The particle diameter of each toner was measured by a particle size analyzer COULTER COUNTER TA-II (available from Beckman Coulter, Inc.) with an aperture diameter of 100 μm. As result, the toner A had a volume average particle diameter (Dv) of 6.2 μm and a number average particle diameter (Dn) of 5.1 μm, and each of the toners B, C, and D had a volume average particle diameter (Dv) of 6.9 μm and a number average particle diameter (Dn) of 6.1 μm.

Subsequently, the circularity was measured by a flow particle image analyzer FPIA-1000 (available from Toa Medical Electronics Co., Ltd.) as an average circularity as follows. First, 0.1 to 0.5 ml of a surfactant (an alkylbenzene sulfonate) as a dispersant was added to 100 to 150 ml of water from which solid impurities had been removed, then 0.1 to 0.5 g of a sample was further added thereto, and a dispersion treatment was performed by an ultrasonic disperser for about 1 to 3 minutes. The resulting dispersion liquid having a concentration of 3,000 to 10,000 particles/μl was set to the above-described analyzer and subjected to a measurement. As a result, the toner A had a circularity of 0.96, and each of the toners B, C, and D had a circularity of 0.94.

Preparation of Carrier

Production Example 1

Core Particle 1

Mn—Mg ferrite having an average particle diameter of 36 μm, an apparent density of 2.11 g/cm$^3$, a σ1000 of 71 emu/g, and a σ500 of 48 emu/g Composition of Resin Liquid 1-1

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Carbon black (Ketjen black): 90 parts by mass Barium sulfate (having an average particle diameter of 0.60 μm): 1,000 parts by mass Toluene: 6,000 parts by mass Composition of Resin Liquid 1-2

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Alumina surface-treated with phosphorus-oxide-doped tin oxide (PTO) (having a powder resistivity of 210 Ω·cm): 200 parts by mass Carbon black (Ketjen black): 50 parts by mass Barium sulfate (having an average particle diameter of 0.60 μm): 1,000 parts by mass Toluene: 6,000 parts by mass The above materials for preparing each of the resin liquids 1-1 and 1-2, each serving as a coating layer forming liquid, were subjected to a dispersion treatment by a HOMOMIXER for 10 minutes. The resin liquid 1-1 was applied onto the core particle 1 by a SPIRA COTA (manufactured by Okada Seiko Co., Ltd.) at a rate of 30 g/min in an atmosphere having a temperature of 55 degrees C. so that the resulting layer had a thickness of 0.20 μm, then the resin liquid 1-2 was applied thereto in the same manner, followed by drying. The thickness of the resulting layer was adjusted by adjusting the amount of the resin liquid. The resulted core particle was burnt in an electric furnace at 150 degrees C. for 1 hour, then cooled, and pulverized with a sieve having an opening of 100 μm. Thus, a carrier 1 was prepared. The average thickness T of the coating layer was 0.40 μm.

The volume average particle diameter of the core particle was measured by a particle size analyzer MICROTRAC SRA (manufactured by Nikkiso Co., Ltd.) while setting the measuring range to from 0.7 to 125 μm.

The average thickness T (μm) of the coating layer was determined by observing a cross-section of the carrier particle with a transmission electron microscope (TEM), measuring the distance between the surface of the core particle and the surface of the coating layer at 50 points along the surface of the carrier particle at intervals of 0.2 μm, and averaging the measured values.

Production Example 2

Core Particle 2

Mn—Mg ferrite having an average particle diameter of 36 μm, an apparent density of 1.93 g/cm$^3$, a σ1000 of 71 emu/g, and a σ500 of 48 emu/g A carrier 2 was prepared in the same manner as in Production Example 1 except for replacing the core particle 1 with the core particle 2.

Production Example 3

Core Particle 3

Mn—Mg ferrite having an average particle diameter of 36 μm, an apparent density of 2.02 g/cm$^3$, a σ1000 of 71 emu/g, and a σ500 of 48 emu/g A carrier 3 was prepared in the same manner as in Production Example 1 except for replacing the core particle 1 with the core particle 3.

Production Example 4

Core Particle 4

Mn—Mg ferrite having an average particle diameter of 36 μm, an apparent density of 2.28 g/cm$^3$, a σ1000 of 71 emu/g, and a σ500 of 48 emu/g A carrier 4 was prepared in the same manner as in Production Example 1 except for replacing the core particle 1 with the core particle 4.

Production Example 5

Core Particle 5

Mn—Mg ferrite having an average particle diameter of 36 μm, an apparent density of 2.19 g/cm$^3$, a σ1000 of 71 emu/g, and a σ500 of 48 emu/g A carrier 5 was prepared in the same manner as in Production Example 1 except for replacing the core particle 1 with the core particle 5.

Production Example 6

Core Particle 6

Mn—Mg ferrite having an average particle diameter of 36 μm, an apparent density of 2.09 g/cm$^3$, a σ1000 of 58 emu/g, and a σ500 of 43 emu/g A carrier 6 was prepared in the same manner as in Production Example 1 except for replacing the core particle 1 with the core particle 6.

Production Example 7

Core Particle 7

Mn—Mg ferrite having an average particle diameter of 36 μm, an apparent density of 2.09 g/cm$^3$, a σ1000 of 59 emu/g, and a σ500 of 44 emu/g A carrier 7 was prepared in the same manner as in Production Example 1 except for replacing the core particle 1 with the core particle 7.

Production Example 8

Core Particle 8

Mn—Mg ferrite having an average particle diameter of 36 μm, an apparent density of 2.13 g/cm$^3$, a σ1000 of 73 emu/g, and a σ500 of 53 emu/g A carrier 8 was prepared in the same manner as in Production Example 1 except for replacing the core particle 1 with the core particle 8.

Production Example 9

Core Particle 9

Mn—Mg ferrite having an average particle diameter of 36 μm, an apparent density of 2.13 g/cm$^3$, a σ1000 of 72 emu/g, and a σ500 of 52 emu/g A carrier 9 was prepared in the same manner as in Production Example 1 except for replacing the core particle 1 with the core particle 9.

Production Example 10

Composition of Resin Liquid 2

Acrylic resin solution (having a solid content concentration of 20% by mass): 400 parts by mass Silicone resin solution (having a solid content concentration of 40% by mass): 4,000 parts by mass Aminosilane (having a solid content concentration of 100% by mass): 20 parts by mass Alumina surface-treated with phosphorus-oxide-doped tin oxide (PTO) (having a powder resistivity of 210 Ω·cm): 200 parts by mass Carbon black (Ketjen black): 140 parts by mass Barium sulfate (having an average particle diameter of 0.60 μm): 2,000 parts by mass Toluene: 12,000 parts by mass A carrier 10 was prepared in the same manner as in Production Example 1 except that only the resin liquid 2 was applied such that the resulting layer had a thickness of 0.4 μm.

Production Example 11

Composition of Resin Liquid 3-2

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Carbon black (Ketjen black): 70 parts by mass Barium sulfate (having an average particle diameter of 0.60 μm): 1,000 parts by mass Toluene: 6,000 parts by mass A carrier 11 was prepared in the same manner as in Production Example 1 except for replacing the resin liquid 1-2 with the resin liquid 3-2.

Production Example 12

Composition of Resin Liquid 4-1

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Carbon black (Ketjen black): 90 parts by mass Toluene: 6,000 parts by mass Composition of Resin Liquid 4-2

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Alumina surface-treated with phosphorus-oxide-doped tin oxide (PTO) (having a powder resistivity of 210 Ω·cm). 200 parts by mass Carbon black (Ketjen black): 50 parts by mass Toluene: 6,000 parts by mass A carrier 12 was prepared in the same manner as in Production Example 1 except for replacing the resin liquids 1-1 and 1-2 with the resin liquids 4-1 and 4-2, respectively.

Production Example 13

Core Particle 10

Mn—Mg ferrite having an average particle diameter of 36 μm, an apparent density of 2.12 g/cm$^3$, a σ1000 of 70 emu/g, and a σ500 of 47 emu/g A carrier 13 was prepared in the same manner as in Production Example 1 except for replacing the core particle 1 with the core particle 10.

Production Example 14

Core Particle 11

Mn—Mg ferrite having an average particle diameter of 36 μm, an apparent density of 2.10 g/cm$^3$, a σ1000 of 60 emu/g, and a σ500 of 45 emu/g A carrier 14 was prepared in the same manner as in Production Example 1 except for replacing the core particle 1 with the core particle 11.

Production Example 15

Core Particle 12

Mn—Mg ferrite having an average particle diameter of 36 μm, an apparent density of 2.08 g/cm$^3$, a σ1000 of 64 emu/g, and a σ500 of 47 emu/g A carrier 15 was prepared in the same manner as in Production Example 1 except for replacing the core particle 1 with the core particle 12.

Production Example 16

Composition of Resin Liquid 5-2

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Alumina surface-treated with phosphorus-oxide-doped tin oxide (PTO) (having a powder resistivity of 190 Ω·cm). 630 parts by mass Barium sulfate (having an average particle diameter of 0.60 μm): 1,000 parts by mass Toluene: 6,000 parts by mass A carrier 16 was prepared in the same manner as in Production Example 15 except for replacing the resin liquid 1-2 with the resin liquid 5-2.

Production Example 17

Composition of Resin Liquid 6-2

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Alumina surface-treated with phosphorus-oxide-doped tin oxide (PTO) (having a powder resistivity of 190 Ω·cm): 200 parts by mass Carbon black (Ketjen black): 45 parts by mass Barium sulfate (having an average particle diameter of 0.60 μm): 1,000 parts by mass Toluene: 6,000 parts by mass A carrier 17 was prepared in the same manner as in Production Example 15 except for replacing the resin liquid 1-2 with the resin liquid 6-2.

Production Example 18

Composition of Resin Liquid 7-2

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Alumina surface-treated with tungsten-oxide-doped tin oxide (WTO) (having a powder resistivity of 40 Ω·cm): 140 parts by mass Barium sulfate (having an average particle diameter of 0.60 μm). 1,000 parts by mass Toluene: 6,000 parts by mass A carrier 18 was prepared in the same manner as in Production Example 15 except for replacing the resin liquid 1-2 with the resin liquid 7-2.

Production Example 19

Composition of Resin Liquid 8-2

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Alumina surface-treated with indium-oxide-doped tin oxide (ITO) (having a powder resistivity of 30 Ω·cm): 100 parts by mass Barium sulfate (having an average particle diameter of 0.60 μm): 1,000 parts by mass Toluene: 6,000 parts by mass A carrier 19 was prepared in the same manner as in Production Example 15 except for replacing the resin liquid 1-2 with the resin liquid 8-2.

Production Example 20

Composition of Resin Liquid 9-2

Acrylic resin solution (having a solid content concentration of 20% by mass): 200 parts by mass Silicone resin solution (having a solid content concentration of 40% by mass): 2,000 parts by mass Aminosilane (having a solid content concentration of 100% by mass): 10 parts by mass Alumina surface-treated with tin oxide (having a powder resistivity of 188 Ω·cm): 198 parts by mass Carbon black (Ketjen black): 45 parts by mass Barium sulfate (having an average particle diameter of 0.60 μm): 1,000 parts by mass Toluene: 6,000 parts by mass A carrier 20 was prepared in the same manner as in Production Example 15 except for replacing the resin liquid 1-2 with the resin liquid 9-2.

Production Example 21

A carrier 21 was prepared in the same manner as in Production Example 18 except for replacing the barium sulfate with a zinc oxide (having an average particle diameter of 0.65 μm)

Production Example 22

A carrier 22 was prepared in the same manner as in Production Example 18 except for replacing the barium sulfate with a magnesium oxide (having an average particle diameter of 0.55 μm).

Production Example 23

A carrier 23 was prepared in the same manner as in Production Example 18 except for replacing the barium sulfate with a magnesium hydroxide (having an average particle diameter of 0.61 μm).

Production Example 24

A carrier 24 was prepared in the same manner as in Production Example 18 except for replacing the barium sulfate with a hydrotalcite (having an average particle diameter of 0.40 μm).

Production Example 25

A carrier 25 was prepared in the same manner as in Production Example 18 except for replacing the barium sulfate with an alumina (having an average particle diameter of 0.62 μm)

Properties of each carrier are shown in Table 1.

TABLE 1

| | Concentration Gradient of Carbon Black and Inorganic Particle A | Proportion of Carbon Black in Region extending from 0.0 to 0.1-μm depth from Surface of Coating Layer (by volume) (%) | Inorganic Particle A Material | Inorganic Particle A Powder Resistivity (Ω · cm) | Inorganic Particle B Material |
|---|---|---|---|---|---|
| Carrier 1 | Yes | 32 | PTO-treated alumina | 210 | Barium sulfate |
| Carrier 2 | Yes | 32 | PTO-treated alumina | 210 | Barium sulfate |
| Carrier 3 | Yes | 32 | PTO-treated alumina | 210 | Barium sulfate |
| Carrier 4 | Yes | 32 | PTO-treated alumina | 210 | Barium sulfate |
| Carrier 5 | Yes | 32 | PTO-treated alumina | 210 | Barium sulfate |
| Carrier 6 | Yes | 32 | PTO-treated alumina | 210 | Barium sulfate |
| Carrier 7 | Yes | 32 | PTO-treated alumina | 210 | Barium sulfate |
| Carrier 8 | Yes | 32 | PTO-treated alumina | 210 | Barium sulfate |
| Carrier 9 | Yes | 32 | PTO-treated alumina | 210 | Barium sulfate |
| Carrier 10 | No | 24 | PTO-treated alumina | 210 | Barium sulfate |
| Carrier 11 | Yes | 36 | — | — | Barium sulfate |
| Carrier 12 | Yes | 32 | PTO-treated alumina | 210 | — |
| Carrier 13 | Yes | 32 | PTO-treated alumina | 210 | Barium sulfate |
| Carrier 14 | Yes | 32 | PTO-treated alumina | 210 | Barium sulfate |
| Carrier 15 | Yes | 32 | PTO-treated alumina | 210 | Barium sulfate |
| Carrier 16 | Yes | 3 | PTO-treated alumina | 190 | Barium sulfate |
| Carrier 17 | Yes | 29 | PTO-treated alumina | 190 | Barium sulfate |
| Carrier 18 | Yes | 3 | WTO-treated alumina | 40 | Barium sulfate |
| Carrier 19 | Yes | 3 | TTO-treated alumina | 30 | Barium sulfate |
| Carrier 20 | Yes | 3 | Aluminum surface-treated with tin oxide | 188 | Barium sulfate |
| Carrier 21 | Yes | 3 | WTO-treated alumina | 40 | Zinc oxide |
| Carrier 22 | Yes | 3 | WTO-treated alumina | 40 | Magnesium oxide |
| Carrier 23 | Yes | 3 | WTO-treated alumina | 40 | Magnesium hydroxide |
| Carrier 24 | Yes | 3 | WTO-treated alumina | 40 | Hydrotalcite |
| Carrier 25 | Yes | 3 | WTO-treated alumina | 40 | Alumina |

| | Inorganic Particle B Average Particle Diameter (μm) | Average Thickness T of Coating Layer (μm) | Core Particle Material | Core Particle Apparent Density (g/cm$^3$) | Core Particle σ1000 (emu/g) | Core Particle σ500 (emu/g) |
|---|---|---|---|---|---|---|
| Carrier 1 | 0.60 | 0.40 | Mn—Mg ferrite | 2.11 | 71 | 48 |
| Carrier 2 | 0.60 | 0.40 | Mn—Mg ferrite | 1.93 | 71 | 48 |
| Carrier 3 | 0.60 | 0.40 | Mn—Mg ferrite | 2.02 | 71 | 48 |
| Carrier 4 | 0.60 | 0.40 | Mn—Mg ferrite | 2.28 | 71 | 48 |

TABLE 1-continued

| | | | | | | |
|---|---|---|---|---|---|---|
| Carrier 5 | 0.60 | 0.40 | Mn—Mg ferrite | 2.19 | 71 | 48 |
| Carrier 6 | 0.60 | 0.40 | Mn—Mg ferrite | 2.09 | 58 | 43 |
| Carrier 7 | 0.60 | 0.40 | Mn—Mg ferrite | 2.09 | 59 | 44 |
| Carrier 8 | 0.60 | 0.40 | Mn—Mg ferrite | 2.13 | 73 | 53 |
| Carrier 9 | 0.60 | 0.40 | Mn—Mg ferrite | 2.13 | 72 | 52 |
| Carrier 10 | 0.60 | 0.40 | Mn—Mg ferrite | 2.11 | 71 | 48 |
| Carrier 11 | 0.60 | 0.40 | Mn—Mg ferrite | 2.11 | 71 | 48 |
| Carrier 12 | — | 0.40 | Mn—Mg ferrite | 2.11 | 71 | 48 |
| Carrier 13 | 0.60 | 0.40 | Mn—Mg ferrite | 2.12 | 70 | 47 |
| Carrier 14 | 0.60 | 0.40 | Mn—Mg ferrite | 2.10 | 60 | 45 |
| Carrier 15 | 0.60 | 0.40 | Mn—Mg—Sr ferrite | 2.08 | 64 | 47 |
| Carrier 16 | 0.60 | 0.40 | Mn—Mg—Sr ferrite | 2.08 | 64 | 47 |
| Carrier 17 | 0.60 | 0.40 | Mn—Mg—Sr ferrite | 2.08 | 64 | 47 |
| Carrier 18 | 0.60 | 0.40 | Mn—Mg—Sr ferrite | 2.08 | 64 | 47 |
| Carrier 19 | 0.60 | 0.40 | Mn—Mg—Sr ferrite | 2.08 | 64 | 47 |
| Carrier 20 | 0.60 | 0.40 | Mn—Mg—Sr ferrite | 2.08 | 64 | 47 |
| Carrier 21 | 0.65 | 0.40 | Mn—Mg—Sr ferrite | 2.08 | 64 | 47 |
| Carrier 22 | 0.55 | 0.40 | Mn—Mg—Sr ferrite | 2.08 | 64 | 47 |
| Carrier 23 | 0.61 | 0.40 | Mn—Mg—Sr ferrite | 2.08 | 64 | 47 |
| Carrier 24 | 0.58 | 0.40 | Mn—Mg—Sr ferrite | 2.08 | 64 | 47 |
| Carrier 25 | 0.62 | 0.40 | Mn—Mg—Sr ferrite | 2.08 | 64 | 47 |

Example 1

A developer 1-A was prepared by mixing 7 parts by mass of the above-prepared toner A and 93 parts by mass of the above-prepared carrier 1 by a mixer for 10 minutes.

The developer was set in a digital full-color printer (IMAGIO MP C6004SP manufactured by Ricoh Co., Ltd.). A chart having an image area ratio of 5% including characters (each having a size of about 2 mm×2 mm) was output on 100,000 sheets and subjected to the following evaluations.

Durability

Durability and image quality were evaluated based on the amount of decrease in charge and the amount of change in carrier resistance before and after the image output on 100,000 sheets.

The amount of decrease in charge was measured as follows.

First, 93% by mass of the initial carrier and 7% by mass of the toner were mixed to prepare a triboelectrically-charged sample. The amount of charge of the sample was measured by a general blow-off method (using TB-200 manufactured by Toshiba Chemical Corporation), and this measured amount was defined as an initial amount of charge. Next, the toner was removed from the developer by the blow-off device after the image output. In the same manner as described above, 93% by mass of the resulted carrier and 7% by mass of the fresh toner were mixed to prepare another triboelectrically-charged sample, and this sample was subjected to the measurement of the amount of charge. The difference between the measured amount of charge and the initial amount of charge was defined as the amount of decrease in charge. The targeted amount of decrease in charge is 10.0 μC/g or less.

The amount of change in carrier resistance was measured as follows.

The carrier was inserted between resistance measurement parallel electrodes (with a gap of 2 mm), then a direct current (DC) of 1000 V was applied, and a resistance value was measured with a high resist meter 30 seconds later. A value obtained by converting the above-measured value into a volume resistivity was defined as an initial resistance value. Next, the toner was removed from the developer by the blow-off device after the image output. In the same manner as described above, the resulted carrier was subjected to the measurement of resistance, and the measured value was converted into a volume resistivity. The difference between the measured resistance value and the initial resistance value was defined as the amount of change in carrier resistance. The targeted amount of change in carrier resistance is 1.0 Log(Ω·cm) or less in absolute value.

Color Contamination

A solid image was output and subjected to a measurement by an X-RITE. Specifically, a value (E) of an image which was output immediately after the developer had been set and a value (E') of another image which was output after the image output on 100,000 sheets were measured by an X-RITE (938 D50 available from X-Rite Inc.), and ΔE was calculated by the following expression. The degree of color contamination was ranked based on ΔE according to the following criteria.

$$\Delta E = E - E'$$

$$E = \sqrt{(L^2 + a^{*2} + b^{*2})}$$

$A+$: $\Delta E \leq 2$ $A$: $2 < \Delta E \leq 4$ $B$: $4 < \Delta E \leq 6$ $C$: $6 < \Delta E$ White Spots Before and after an image output on 1,000,000 sheets, a solid image and an image of a 2-dot line (100 lpi/inch) pattern in the sub-scanning direction were each output on an sheet of A3-size paper. The number of white spots generated by carrier particles deposited on the solid image and between the lines of the 2-dot line pattern was measured by visual observation and ranked according to the following criteria.

A: Good

B: Acceptable

C: Unacceptable for practical use

Solid Image Density Evenness after Continuous Output

The solid image density evenness in continuous output was evaluated by continuously outputting a solid image on 10 sheets of A4-size paper and visually confirming the degree of density unevenness of the images on 10 sheets.

A: Change in the degree of density unevenness is not visually confirmed.

B: The degree of density unevenness is worsened but acceptable.

C: The degree of density unevenness is clearly worsened and unacceptable.

Examples 2 to 4

The evaluations were performed in the same manner as in Example 1 except for replacing the toner A with each of the toners B, C, and D and replacing the developer 1-A with each of the developers 1-B, 1-C, and 1-D.

Examples 5 to 21 and Comparative Examples 1 to 7

The evaluations were performed in the same manner as in Example 1 except for replacing the carrier 1 with each of the carriers 2 to 25 and replacing the developer 1-A with each of the developers 2-A to 25-A.

The combinations of carrier and toner in each developer and evaluation results for the Examples and Comparative Examples are shown in Table 2.

TABLE 2

| | | | | Durability (Charging) | | | Durability (Resistance Value) |
|---|---|---|---|---|---|---|---|
| | Developer | Carrier | Toner | Before Output (μC/g) | After Output (μC/g) | Amount of Decrease (μC/g) | Amount of Change ((log)Ω · cm) |
| Example 1 | 1-A | Carrier 1 | Toner A | −29 | −25 | 4 | 0.6 |
| Example 2 | 1-B | Carrier 1 | Toner B | −26 | −22 | 4 | 0.7 |
| Example 3 | 1-C | Carrier 1 | Toner C | −27 | −23 | 4 | 0.6 |
| Example 4 | 1-D | Carrier 1 | Toner D | −28 | −24 | 4 | 0.6 |
| Comparative Example 1 | 2-A | Carrier 2 | Toner A | −29 | −25 | 4 | 1.1 |
| Example 5 | 3-A | Carrier 3 | Toner A | −29 | −25 | 4 | 0.6 |
| Comparative Example 2 | 4-A | Carrier 4 | Toner A | −29 | −25 | 4 | 0.6 |
| Example 6 | 5-A | Carrier 5 | Toner A | −29 | −25 | 4 | 0.6 |
| Comparative Example 3 | 6-A | Carrier 6 | Toner A | −29 | −25 | 4 | 0.6 |
| Example 7 | 7-A | Carrier 7 | Toner A | −29 | −25 | 4 | 0.6 |
| Comparative Example 4 | 8-A | Carrier 8 | Toner A | −29 | −25 | 4 | 0.6 |
| Example 8 | 9-A | Carrier 9 | Toner A | −29 | −25 | 4 | 0.6 |
| Comparative Example 5 | 10-A | Carrier 10 | Toner A | −28 | −23 | 5 | 0.5 |
| Comparative Example 6 | 11-A | Carrier 11 | Toner A | −30 | −26 | 4 | 0.8 |
| Comparative Example 7 | 12-A | Carrier 12 | Toner A | −27 | −14 | 13 | 1.6 |
| Example 9 | 13-A | Carrier 13 | Toner A | −29 | −25 | 4 | 0.6 |
| Example 10 | 14-A | Carrier 14 | Toner A | −29 | −25 | 4 | 0.6 |
| Example 11 | 15-A | Carrier 15 | Toner A | −29 | −25 | 4 | 0.6 |
| Example 12 | 16-A | Carrier 16 | Toner A | −31 | −28 | 3 | 0.3 |
| Example 13 | 17-A | Carrier 17 | Toner A | −28 | −23 | 5 | 0.6 |
| Example 14 | 18-A | Carrier 18 | Toner A | −29 | −26 | 3 | 0.3 |
| Example 15 | 19-A | Carrier 19 | Toner A | −29 | −26 | 3 | 0.2 |
| Example 16 | 20-A | Carrier 20 | Toner A | −29 | −26 | 3 | 0.3 |
| Example 17 | 21-A | Carrier 21 | Toner A | −27 | −22 | 5 | 0.3 |
| Example 18 | 22-A | Carrier 22 | Toner A | −27 | −22 | 5 | 0.3 |
| Example 19 | 23-A | Carrier 23 | Toner A | −27 | −22 | 5 | 0.3 |
| Example 20 | 24-A | Carrier 24 | Toner A | −28 | −24 | 4 | 0.3 |
| Example 21 | 25-A | Carrier 25 | Toner A | −26 | −17 | 9 | 0.3 |

TABLE 2-continued

| | Color Contamination ΔE (Rank) | White Spots Visual Evaluation (Rank) | Solid Image Density Evenness after Continuous Output Visual Evaluation (Rank) | Remarks |
|---|---|---|---|---|
| Example 1 | A | B | A | |
| Example 2 | A+ | B | A | E value is low because of black toner. Color contamination prevention effect is not remarkable. |
| Example 3 | A | B | A | |
| Example 4 | A | B | A | |
| Comparative Example 1 | A | B | A | |
| Example 5 | A | B | B | |
| Comparative Example 2 | A | B | C | |
| Example 6 | A | B | B | |
| Comparative Example 3 | A | B | C | |
| Example 7 | A | B | B | |
| Comparative Example 4 | A | B | C | |
| Example 8 | A | B | B | |
| Comparative Example 5 | C | B | A | |
| Comparative Example 6 | C | B | A | |
| Comparative Example 7 | A | B | A | |
| Example 9 | A | A | A | |
| Example 10 | A | A | A | |
| Example 11 | A | A | A | |
| Example 12 | A+ | A | A | |
| Example 13 | A+ | A | A | |
| Example 14 | A+ | A | A | |
| Example 15 | A+ | A | A | |
| Example 16 | A+ | A | A | |
| Example 17 | A+ | A | A | |
| Example 18 | A+ | A | A | |
| Example 19 | A+ | A | A | |
| Example 20 | A+ | A | A | |
| Example 21 | A+ | A | A | |

It is clear from the results shown in Table 2, the developers according to Examples have excellent durability, prevent the occurrence of color contamination, and provide stable image quality even when used for a long period of time, compared to the developers of Comparative Examples. In addition, the solid image density evenness after continuous output was also good.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A carrier for forming an electrophotographic image, comprising:

a core particle comprising a manganese-based ferrite particle having an apparent density of from 2.0 to 2.2 g/cm$^3$ and a magnetization of from 44 to 52 emu/g in a magnetic field of 500 Oe; and a coating layer coating a surface of the core particle, the coating layer containing a carbon black, an inorganic particle A, and an inorganic particle B, wherein the inorganic particle A and the carbon black each have a concentration gradient in a thickness direction of the coating layer, a concentration of the inorganic particle A increases toward a surface of the coating layer, and a concentration of the carbon black decreases toward the surface of the coating layer, and wherein the core particle has a magnetization of from greater than 60 to 70 or less emu/u in a magnetic field of 1.000 Oe.

2. The carrier according to claim 1, wherein the core particle comprises strontium.

3. The carrier according to claim 1, wherein a proportion of the carbon black in a region extending from 0.0 to 0.1 μm-depth from the surface of the coating layer is from 0% to 30% by volume, wherein the inorganic particle A comprises a conductive particle having a powder resistivity of 200 Ω·cm or less.

4. The carrier according to claim 1, wherein the inorganic particle A comprises a tin oxide doped with at least one member selected from the group consisting of tungsten, indium, phosphorus, and oxides of tungsten, indium, and phosphorus.

5. The carrier according to claim 4, wherein the inorganic particle A comprises:

a base particle; and the tin oxide doped with said at least one member, disposed on a surface of the base particle.

6. The carrier according to claim 1, wherein the core particle has a magnetization of 64 to 70 emu/g in a magnetic field of 1,000 Oe.

7. The carrier according to claim 1, wherein the manganese-based ferrite particle is Mn—Mg ferrite particle.

8. The carrier according to claim 1, wherein the manganese-based ferrite particle is Mn—Mg—Sr ferrite particle.

9. A developer for forming an electrophotographic image, comprising the carrier according to claim 1; and a toner.

10. The developer according to claim 9, wherein the toner is a negatively-chargeable toner, wherein the inorganic particle B comprises at least one member selected from the group consisting of barium sulfate, zinc oxide, magnesium oxide, magnesium hydroxide, and hydrotalcite.

11. The developer according to claim 9, wherein the toner is at least one member selected from the group consisting of a yellow toner, a white toner, and a transparent toner.

12. A method for forming an electrophotographic image, comprising:

charging an electrostatic latent image bearer;

forming an electrostatic latent image on the electrostatic latent image bearer;

developing the electrostatic latent image formed on the electrostatic latent image bearer into a toner image with the developer according to claim 9;

transferring the toner image formed on the electrostatic latent image bearer onto a recording medium; and fixing the toner image on the recording medium.

13. A process cartridge comprising:

an electrostatic latent image bearer;

a charger configured to charge the electrostatic latent image bearer;

a developing device containing the developer according to claim 9, configured to develop an electrostatic latent image formed on the electrostatic latent image bearer with the developer to form a toner image; and a cleaner configured to clean the electrostatic latent image bearer.

14. A carrier for forming an electrophotographic image, comprising:

a core particle comprising a manganese-based ferrite particle having an apparent density of from 2.0 to 2.2 g/cm3 and a magnetization of from 44 to 52 emu/g in a magnetic field of 500 Oe; and a coating layer coating a surface of the core particle, the coating layer containing a carbon black, an inorganic particle A, and an inorganic particle B, wherein the inorganic particle A and the carbon black each have a concentration gradient in a thickness direction of the coating layer, a concentration of the inorganic particle A increases toward a surface of the coating layer, and a concentration of the carbon black decreases toward the surface of the coating layer, and wherein the core particle has a magnetization of from 70 to 73 emu/g in a magnetic field of 1,000 Oe.

* * * * *